US005407185A

United States Patent [19]

Zehnpfennig et al.

[11] Patent Number: 5,407,185

[45] Date of Patent: Apr. 18, 1995

[54] RECONFIGURABLE CLAMP

[75] Inventors: David M. Zehnpfennig; Matthew G. Driggs, both of Manhattan Beach; Danny R. Chandler, Redondo Beach, all of Calif.

[73] Assignee: Hughes Aircraft Company, Los Angeles, Calif.

[21] Appl. No.: 112,747

[22] Filed: Aug. 26, 1993

[51] Int. Cl.[6] ..... B25B 1/24

[52] U.S. Cl. ..... 269/266

[58] Field of Search ..... 269/266, 20, 32, 90, 269/224, 275, 286; 294/88, 119.1, 902; 901/30, 31, 36, 37, 39

[56] References Cited

U.S. PATENT DOCUMENTS

| | | | |
|---|---|---|---|
| 2,882,771 | 4/1959 | Blazek | 269/266 |
| 4,088,312 | 5/1978 | Frosch et al. | 269/266 |
| 4,572,564 | 2/1986 | Cipolla | 269/266 |
| 4,752,063 | 6/1988 | Nagy | 269/266 |
| 4,936,560 | 6/1990 | Barozzi | 269/266 |

*Primary Examiner*—Robert C. Watson

*Attorney, Agent, or Firm*—Michael W. Sales; Wanda K. Denson-Low

[57] ABSTRACT

A reconfigurable clamping and supporting apparatus. The inventive apparatus (20) includes first and second arrays (32, 34) of elements (30) and a mechanism for activating same (60, 62, 64-49). The first array (32) comprises at least two rows of elements (30) extending along a first axis and at least two columns of elements extending along a second axis substantially transverse to the first axis. The second array (34) comprises at least two rows of elements (30) extending along the first axis and at least two columns of elements extending along the second axis. Each of the elements (30) is adapted to reciprocate from a first position to a second position along a third axis substantially transverse to the first and second axes. The first position is a home position and the second position is a retaining position. The second array (34) is mounted in opposing face-to-face relation relative to the first array (32) to retain an object therebetween when at least one element of each array is disposed at the second position.

14 Claims, 8 Drawing Sheets

62
AIR SUPPLY
60
CONTROLLER
VALVE 1
64
VALVE 2
66
VALVE 3
65
68
69
67
CLAMP
UNCLAMP
TRAIN/TEACH
36
320
306
312
20
29
302
28
308
32
310
30
44
34
308
26
302
38
306
312

RECONFIGURABLE CLAMP

BACKGROUND OF THE INVENTION

1. Field of the Invention

The present invention relates to tooling apparatus. More specifically, the present invention relates to devices used to clamp work pieces during manufacturing operations.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

In many applications, a clamp is needed to hold two work pieces in position to perform a manufacturing operation. In automotive manufacturing, for example, a number of structural members must be held together and welded to construct a skeletal structure or framework commonly referred to as a "body in white". Most manufacturers use a numerically controlled machined block as a clamp at every point at which the structural members must be held together during the welding operation. While this provides a consistent, reliable, durable clamping arrangement, it is quite costly. For every model or design of vehicle, a specific customized clamp or numerically machined block must be provided for every welding point of the 'body in white'. The design and manufacture of the clamps is costly and time consuming. For example, it may require one and one-half years to design and manufacture the tooling necessary to manufacture a given vehicle. A typical factory may spend 400 to 600 dollars for each numerically machined block. With each subassembly having 20 to 30 blocks and 30 to 40 subassemblies for each vehicle design, with three or four machines making each subassembly, the cost associated with the conventional clamping tool is substantial. These costs are not transferable and are generally lost when the model is discontinued.

Thus, a need has been recognized in the art for reusable, reconfigurable clamps. U. S. Pat. No. 4,691,905, entitled MACHINE FOR HOLDING WORKPIECE, issued Sep. 8, 1987 to Tamura et al., describes several methods for fixturing vehicle frames prior to the performance of a manufacturing operation. While a programmable fixture is disclosed, it has several disadvantages. Firstly, it is trained or contoured to the part with actuators and actuator controls (typically servo-motors) which are costly, unreliable and imprecise. In addition, the positioning manipulator must carry the weight and size of the actuators along with the tooling, requiring larger, stronger, more costly manipulators.

Secondly, while individual plates are used to reconfigure the clamp, the disclosed clamp is only two dimensional in that it allows contouring with only two degrees of freedom. Accordingly, it can only be contoured to a limited set of vehicle components.

Thirdly, the constant width of the plates restricts the fixture from obtaining shapes necessary for fixturing at tooling holes and slots commonly known as principle locating points. Hence, the clamp cannot generally be used to precisely locate the part in space. This is significant because it requires that the parts be presented in the correct position and orientation or that a sensor system be used to locate the position of the part. Both result in higher tooling costs and lower overall framing accuracy.

Thus, a need remains in the art for an inexpensive, reliable, durable, reusable, reconfigurable clamp which allows contouring with more than two degrees of freedom, which may be inexpensively customized, provides accurate part location, and which does not require servo-motors for training.

SUMMARY OF THE INVENTION

The need in the art is addressed by the present invention which provides a reconfigurable clamping and supporting apparatus of novel design and operation. The inventive apparatus includes first and second arrays of elements and a mechanism for activating same. The first array comprises at least two rows of elements extending along a first axis and at least two columns of elements extending along a second axis substantially transverse to the first axis.

The inventive apparatus further includes a second array of elements. The second array comprises at least two rows of elements extending along the first axis and at least two columns of elements extending along the second axis. Each of the elements is adapted to reciprocate from a first position to a second position along the third axis. The first position is a home position and the second position is a retaining position. The second array is mounted in opposing face-to-face relation relative to the first array to retain an object therebetween when at least one element of each array is disposed at the second position.

The invention provides an inexpensive, reliable, durable, reusable, reconfigurable clamp which allows contouring with more than two degrees of freedom, which may be inexpensively customized, provides accurate part location, and which does not require servo-motors for training.

DESCRIPTION OF THE INVENTION

Illustrative embodiments and exemplary applications will now be described with reference to the accompanying drawings to disclose the advantageous teachings of the present invention.

Figure 1:
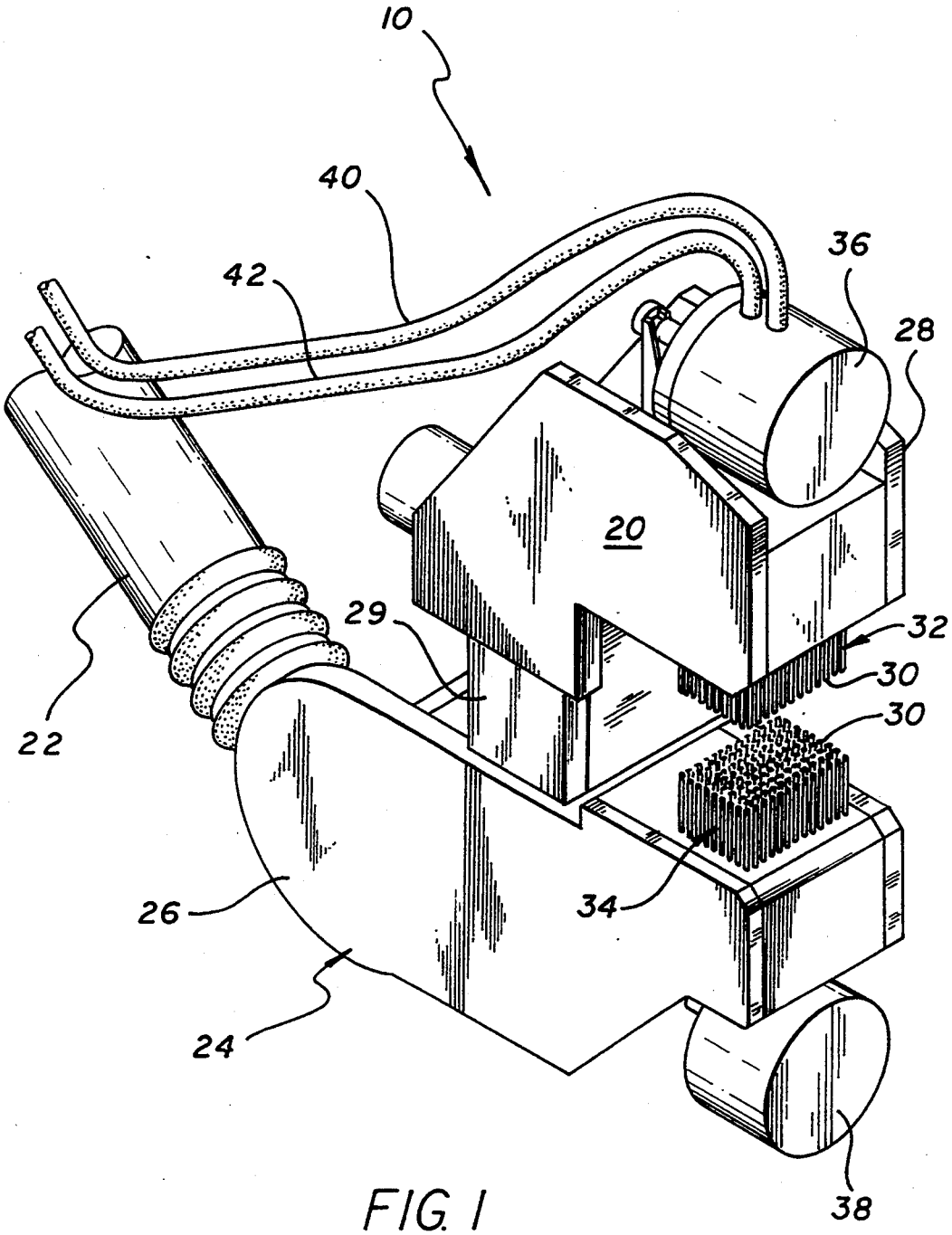
FIG. 1 is a perspective view of an illustrative embodiment of a reconfigurable clamp assembly incorporating the teachings of the present invention.

FIG. 1 is a perspective view of an illustrative embodiment of a reconfigurable clamp assembly incorporating the teachings of the present invention.

Figure 2B:
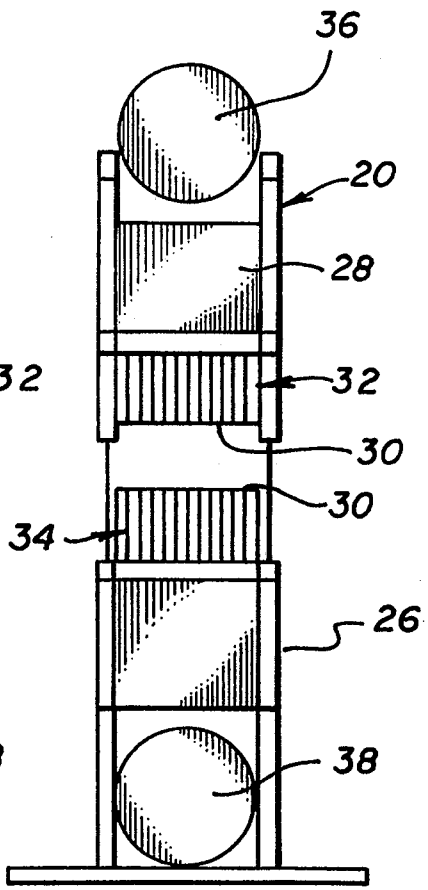
FIGS. 2*a*, 2*b* and 2*c* depict side, front and top views, respectively, of the illustrative embodiment of a reconfigurable clamp assembly of FIG. 1.
Figure 2A:
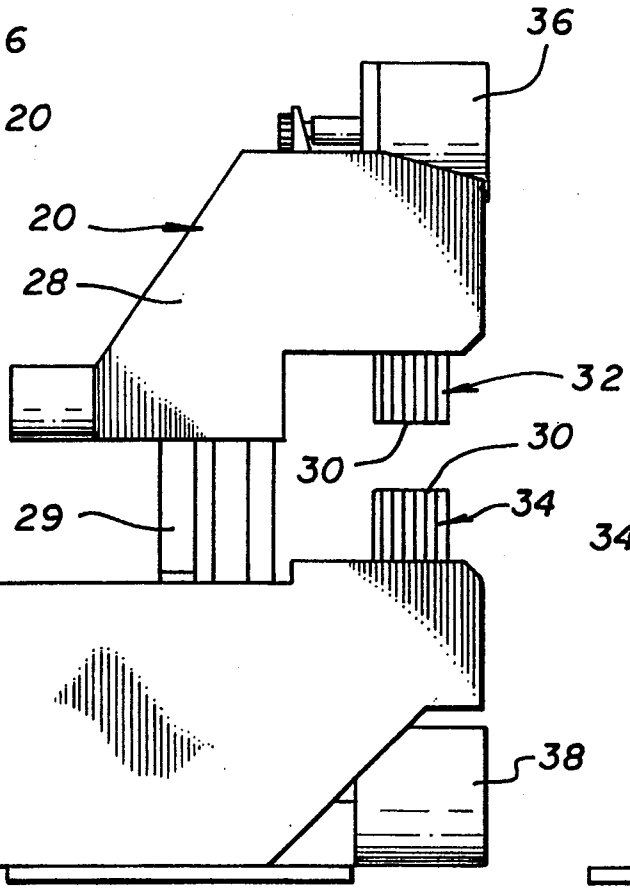
Figure 2C:
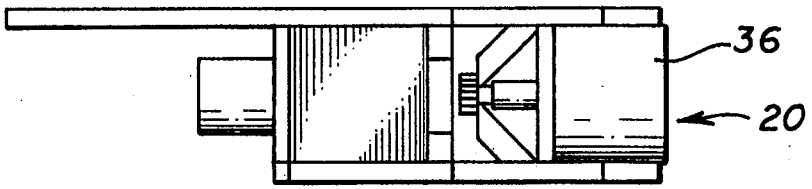

FIGS. 2*a*, 2*b* and 2*c* depict side, front and top views, respectively, of the illustrative embodiment of a reconfigurable clamp assembly of FIG. 1.

As illustrated in FIG. 1, the assembly 10 includes a reconfigurable clamp 20 in a "C" configuration mounted at the end of a conventional positioner arm 22. The arm 22 serves to position the clamp 20 and provide pneumatic pressure thereto. The positioner arm 22 engages the lower portion 26 of the clamp 20. An upper portion 28 of the clamp 20 is connected to the lower portion 26 by a middle section 29. The assembly may be constructed of steel or aluminum. The middle section 29 may be implemented with a conventional industrial clamp.

First and second arrays 32 and 34 of rods 30 are mounted in the upper and lower portions of the clamp 28 and 26, respectively. The first array 32 comprises multiple columns of rods 30 extending along a first (x) axis and multiple rows of rods extending along a second axis (y) substantially transverse to the first axis. Each of the rods 30 is adapted to reciprocate back and forth between a first home position and a second clamp position along a third (z) axis substantially transverse to the first and second axes.

Likewise, the second array 34 comprises multiple columns of rods 30 extending along the first axis and multiple rows of rods 30 extending along the second axis. Again, each of the rods 30 is adapted to reciprocate back and forth between a first position and a second position along the third axis. The second array 34 is mounted in opposing face-to-face relation relative to the first array 32 to retain an object therebetween when at least one rod of each array is disposed at the second position.

As discussed more fully below, the rods 30 are actuated to translate from the home position into engagement with an object. In the illustrative embodiment, the rods 30 move independently to assume the contour and conform to the shape of an object, e.g., a workpiece, with three degrees of freedom, in response to the application of pneumatic pressure thereto. As each of the rods is positionally configurable to its neighbors, the arrays of rods form surfaces configurable to the three dimensional contour of the workpiece.

The rods 30 may be of any shape including without limitation, square, rectangular, triangular, circular, hexagonal and other shapes. In the preferred embodiment, the rods 30 are assembled in the arrays 32 and 34 such that each rod is touching its nearest neighbor with an air gap of 0.001 inch therebetween. In general, the gap between the rods should be large enough to allow the rods to move independently and small enough to allow the rods to be locked in the retain position to hold the workpiece securely in place. The gap of 0.001 inch in the preferred embodiment allows the pressurizing gas to escape between the rods on depressurization. The flow of gas is also effective to clean debris between the rods.

First and second pneumatic cylinders 36 and 38 are mounted on the housing 24. The cylinders 36 and 38 are part of a locking mechanism which holds the rods in place in the second position to firmly retain a workpiece. Pneumatic lines 40 and 42 serve to provide gas pressure to the cylinders 36 and 38. The design of the locking mechanism is discussed more fully in connection with FIG. 3 below.

Figure 3A:
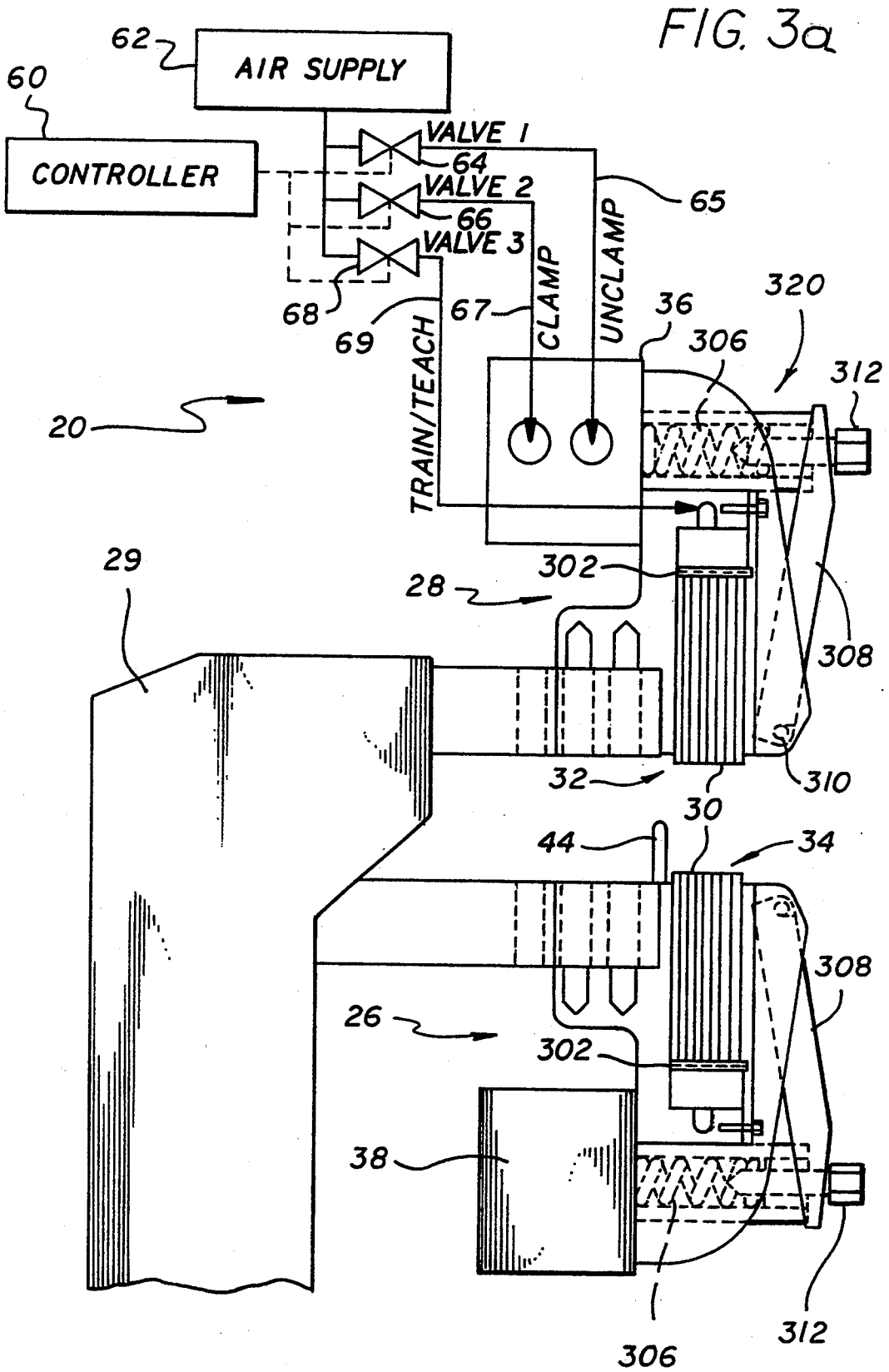
FIG. 3*a* is a magnified partial sectional side view of the clamp of FIG. 1 including a pneumatic schematic.

FIG. 3*a* is a magnified partial sectional side view of the clamp 20 of FIG. 1 including a pneumatic schematic. In FIG. 3*a*, the first and second arrays of rods 30 are shown in the first home position. A reference pin 44 is mounted in the lower portion 26 adjacent to the second array 34. As discussed more fully below, the reference pin 44 facilitates an optimal placement of a workpiece within the clamp 20.

Figure 3B:
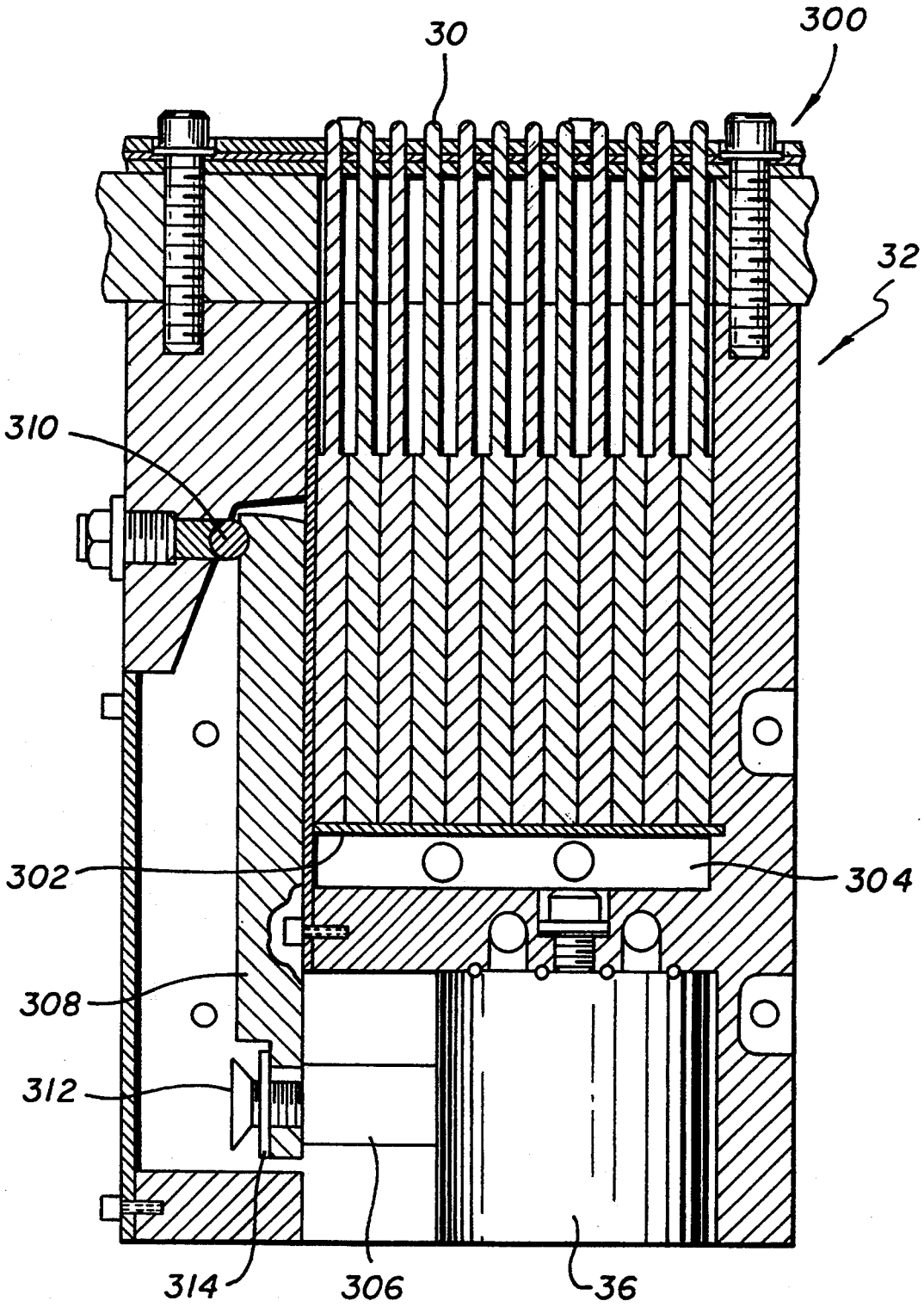
FIG. 3*b* is a magnified sectional side view of an array of rods constructed in accordance with the present teachings.
Figure 3C:
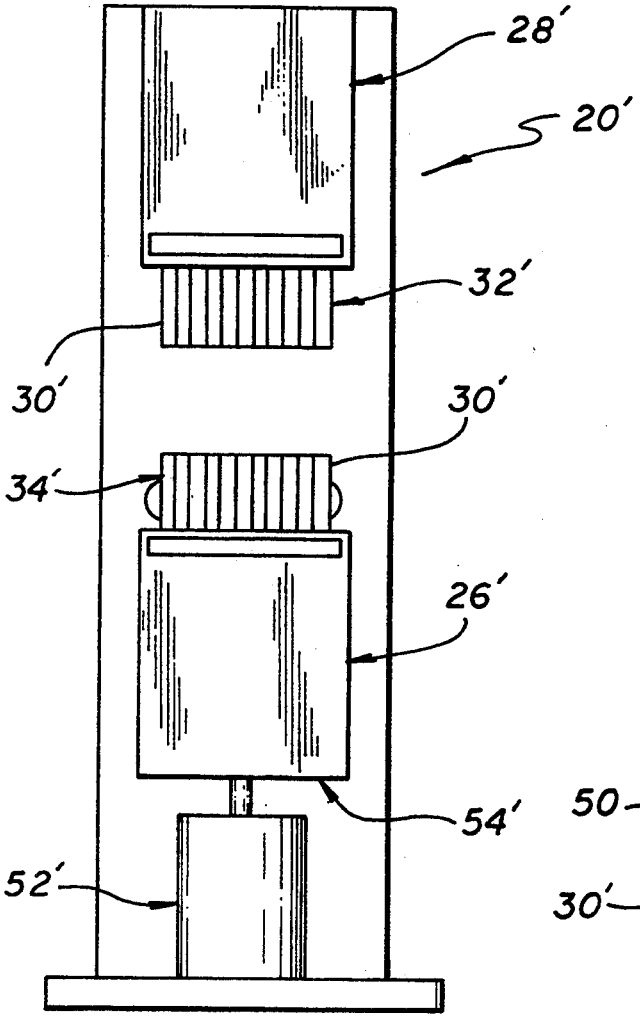
FIG. 3*c* is a simplified diagram of an alternative embodiment of the invention without a workpiece.

FIG. 3*b* is a magnified sectional side view of an illustrative array of rods constructed in accordance with the present teachings. Both arrays may be of identical construction, hence, only one array is described here. The elongate rods 30 are mounted parallel and adjacent to one another. In the illustrative embodiment of FIG. 3*b*, the rods 30 are square cylinders at the bottom ends thereof and round cylinders at the upper ends thereof. The tips are rounded as well. The upper ends of the rods extend through an encapsulation plate 300. The encapsulation plate is a thin planar piece of brass and serves to protect the array of rods from debris. A wire mesh 302 limits the range of movement of the rods 30 and thereby defines the home position for same. A chamber 304 is provided on the other side of the mesh 302. When the chamber 304 is filled with gas, pneumatic pressure is exerted against the back side of the rods 30 causing the rods to translate. The rods 30 will move into contact with a workpiece. At this position, the rods are "trained". The workpiece will be secured in position when the trained rods are clamped or locked in position.

Clamping is achieved with a locking mechanism comprising an air cylinder 36, a piston 306, a lever arm 308, and a pivot point 310. The piston 306 is adapted to be translated by gas pressure in the piston 36. The lever arm 308 is bolted to the piston 306 by a screw 312 and a washer 314. The lever arm 308 is mounted so that rotational movement about the pivot point 310, induced by translation of the piston 306, will cause the lever arm 308 to exert pressure on the side of the array 32 of rods 30. This forces the rods into immediate contact with one another, creating frictional forces sufficient to hold the rods in the clamped position. In the clamped position, the above-noted small air gap between the lower portion of the rods is eliminated.

To unclamp the rods, the cylinder 36 is evacuated. When the cylinder 36 is evacuated, the piston 306 is retracted and the rods are again free to move independently. In a vertical orientation, the evacuation of the chamber 304 returns the rods in the lower array 34 to the home or fully transversed position. In other orientations, the rods maintain position until moved.

Returning to FIG. 3*a*, the movement and locking of the rods in position is controlled by a controller 60. The controller 60 may be implemented with microcomputer or an analog or digital control circuit. The controller 60 controls the flow of gas from a supply 62 to the clamp 20 via electronically activated first, second and third flow control valves 64, 66, and 68. The first valve 64 is connected to an evacuation line 65. The first valve 64 and the evacuation line 65 withdraw gas from the cylinder 36 to unclamp the rods 30 of the associated array. The second valve 66 provides gas pressure to the cylinder 36 via a line 67 to clamp the rods 30 of the associated array. The third valve 68 provides gas to the chamber 304 of the associated array via a teach/train line 69 to train the rods. The teach/train line 69 provides gas to the rods to cause the rods to transverse the rods along the 'z' axis. Thus, the teach/train line 69 moves the rods to and from the home position and to and from the position at which the rods are in contact with the workpiece.

In FIG. 3*a*, the locking mechanism of the first array 32 is activated while the locking mechanism of the second array 34 is in the 'unlock' position. The locking/unlocking is performed via an air cylinder with extend and retract action. A fail-safe spring 320 is provided to lock the pins when the controller power or air fails.

Figure 4A:
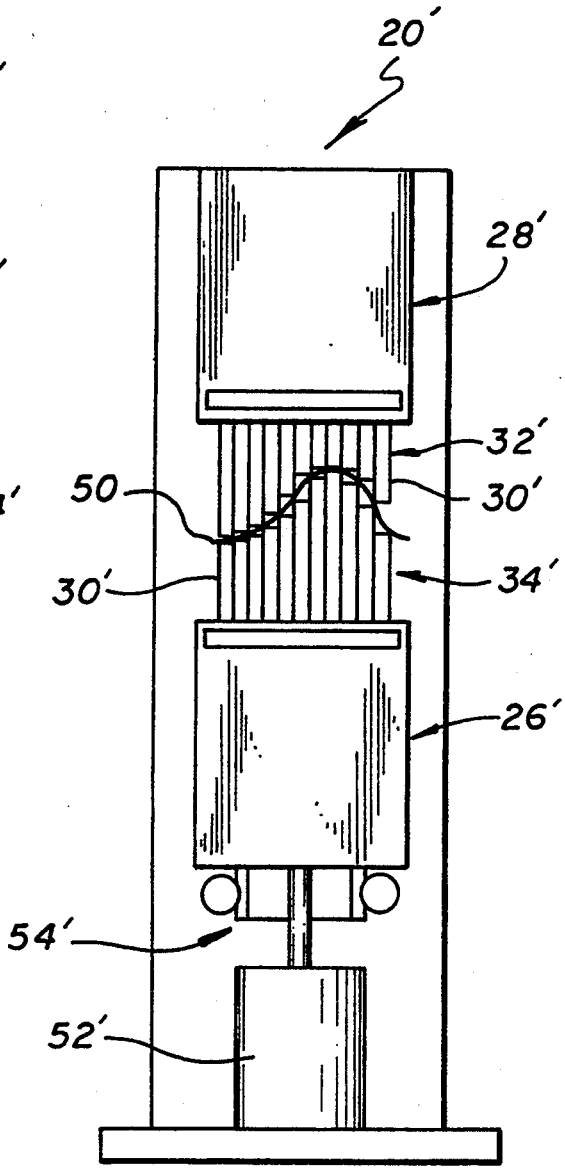
FIG. 4*a* is a simplified diagram of a front view of an alternative embodiment of the reconfigurable clamp of the present invention showing a workpiece in cross-section.
Figure 4B:
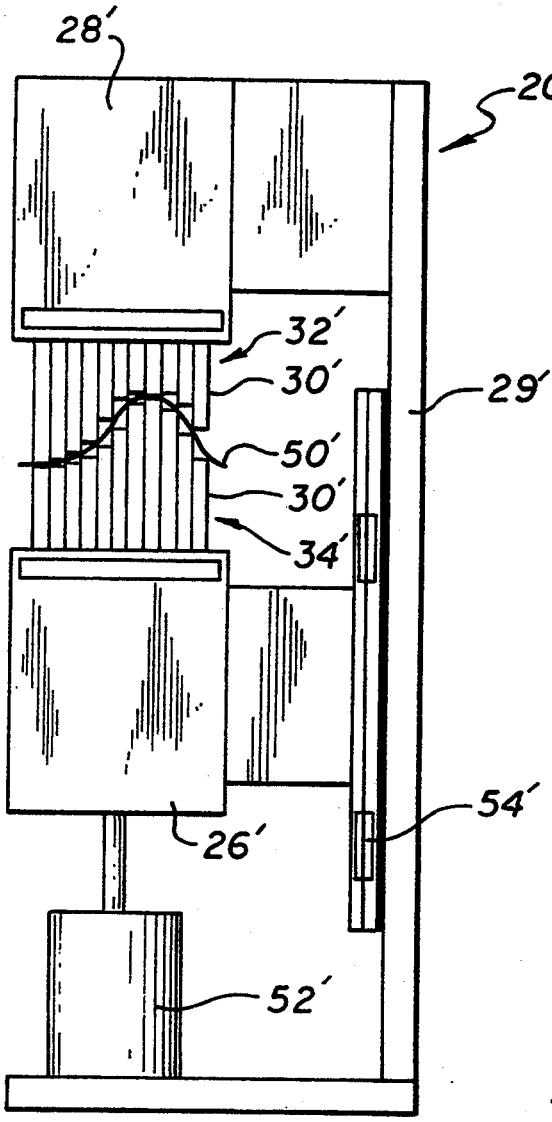
FIG. 4*b* is a simplified diagram of a side view of the alternative embodiment of the reconfigurable clamp of FIG. 4*a*.
Figure 4C:
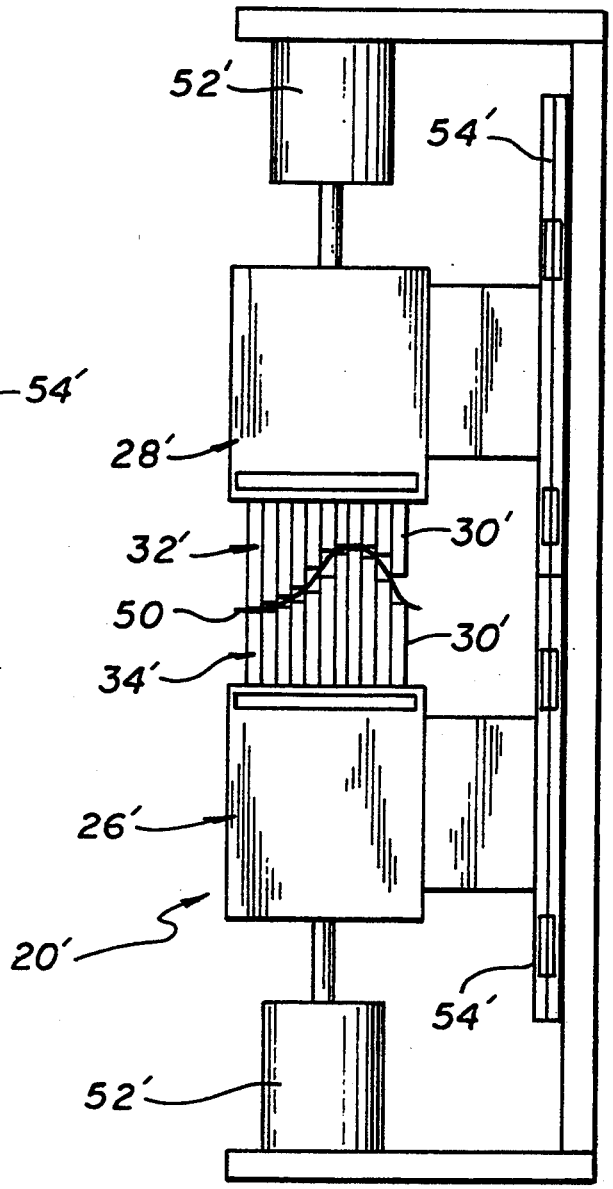
FIG. 4*c* is a simplified diagram of a side view of a second alternative embodiment of the reconfigurable clamp of the present invention with top and bottom clamping actuators.

FIG. 4*a* is a simplified diagram of a front view of an alternative embodiment of the reconfigurable clamp 20' of the present invention showing a workpiece 50 in cross-section. FIG. 4*b* is a simplified diagram of a side view of the alternative embodiment of the reconfigurable clamp of FIG. 4*a*. FIGS. 4*a* and 4*b* illustrate that multiple sides of the clamp 20 can be used to fixture a workpiece 50. The embodiment of FIGS. 4*a* and 4*b* is identical to that of FIG. 1 with the exception that a clamping actuator 52 is included. The clamping actuator 52 drives the lower housing 26' on a mechanical slide 54'. This provides gross positioning of the clamp 20 and the bulk of the clamping force applied to a workpiece. As depicted in FIG. 4*c*, a second clamping actuator may be used to translate the upper housing 28' as well. FIG. 4*c* is a simplified diagram of a side view of a second alternative embodiment of the reconfigurable clamp of the present invention with top and bottom clamping actuators.

Figure 5A:
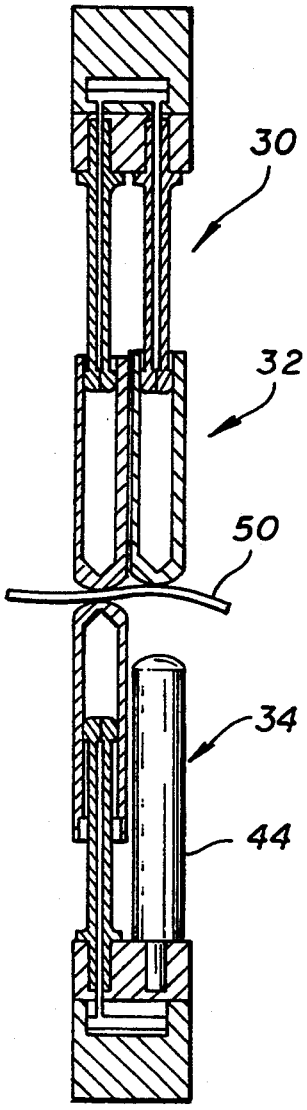
FIGS. 5*a*–5*e* depict the sequence of operation of the reconfigurable clamp assembly of the present invention.
Figure 5B:
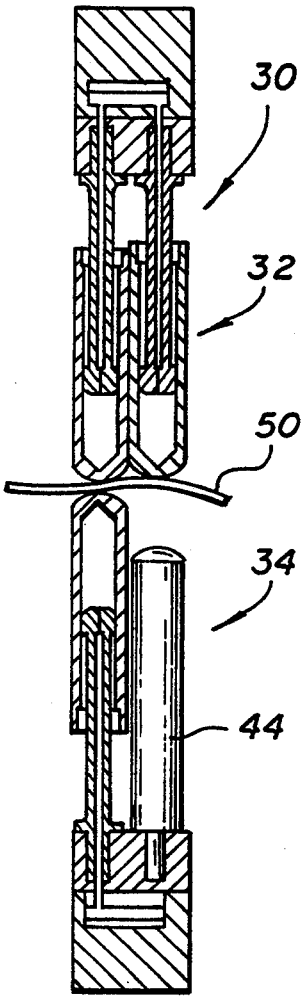
Figure 5C:
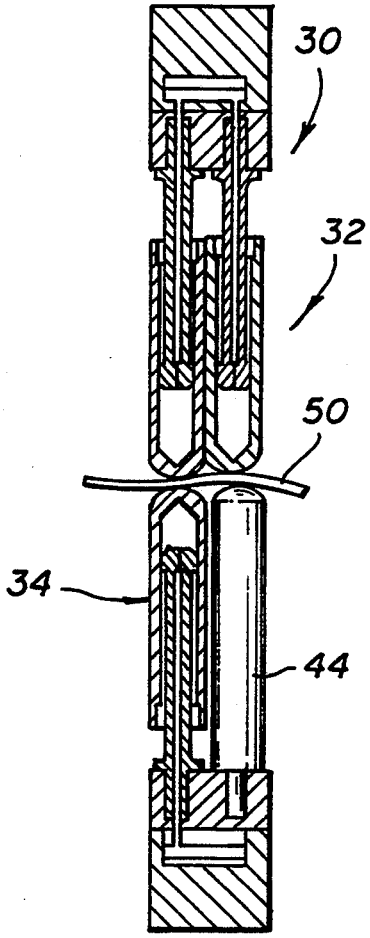
Figure 5D:
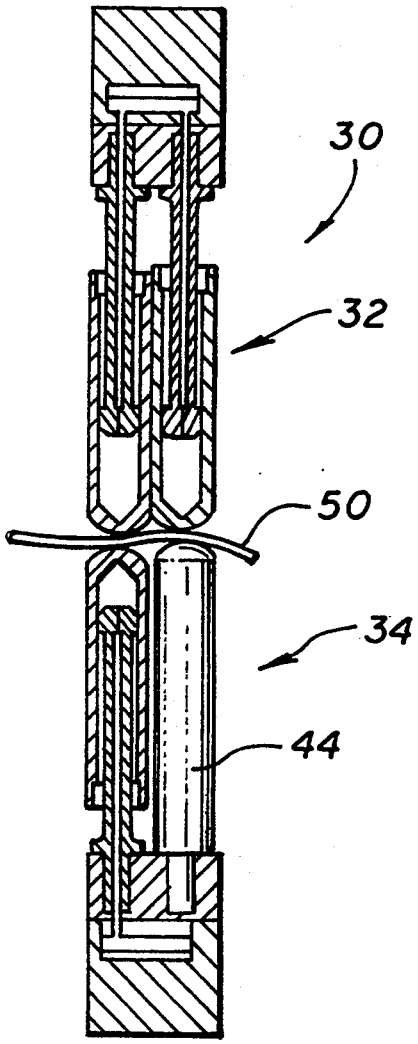
Figure 5E:
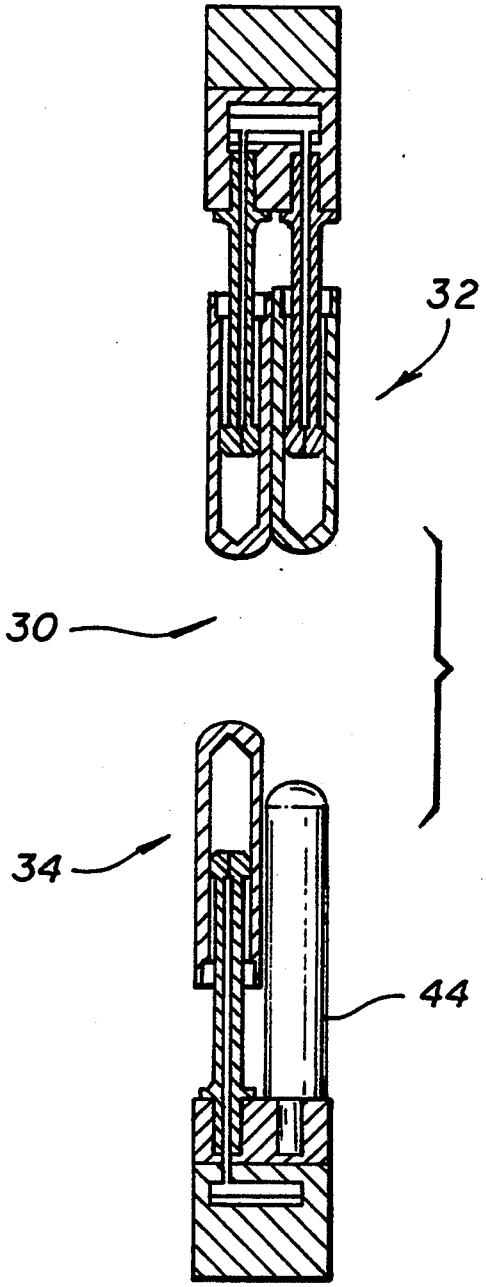

The operation of the reconfigurable clamp 20 of the present invention is best described with reference to FIGS. 5*a* through 5*e*. FIGS. 5*a*–5*e* depict the sequence of operation of the reconfigurable clamp assembly of the present invention. First, as depicted in FIG. 5*a*, the rods in the upper and lower arrays 32, 34 are unlocked as the clamping actuator closes such that the rods begin to engage a workpiece 50. As shown in FIG. 5*b*, as the rods in the upper array engage the workpiece 50, the workpiece is moved toward the reference pin 44 to the point of engagement therewith as shown in FIG. 5*c*. At this point the rods are locked in position, FIG. 5*d* as the workpiece 50 is tooled. Thereafter, the rods are unlocked and the clamping actuator returns to the home position as shown in FIG. 5*e* to allow the workpiece to be removed.

In an alternative mode of operation, the rods are unlocked and the clamping actuators are retracted to the home position. Next, a "golden" sample or the workpiece 50 is moved into position on the reference pin 44 between the upper and lower arrays 32, 34 of the clamp. With the workpiece 50 in position, the rod clamping devices are released and air is driven behind each rod in the upper array 32. The rods act as individual pneumatic pistons and move into contact with the golden sample or the workpiece. Next, the rods of the lower array 34 are activated and move into contact with the workpiece. The rod locking mechanism is activated clamping the rods in place. Next, the rod clamping actuators are actuated to apply a full clamping force to the workpiece. The clamping force may be increased by pneumatically driving a wedge between the clamping actuator and the base plate the housing of the arrays. If the golden sample is used, it is removed after completion of the training process and used to tool workpieces. When the desired manufacturing operations are completed on a given workpiece, the rod clamping actuators are released to replace the workpiece with another workpiece. When all workpieces of the same contour have been machined, the rod locking devices are released and the rods are returned to the home position.

The present invention has been described herein with reference to a particular embodiment for a particular application. Those having ordinary skill in the art and access to the present teachings will recognize additional modifications applications and embodiments within the scope thereof. For example, the invention is not limited to the shape of the rods as set forth in the illustrative embodiments, nor the manner by which the rods move or are clamped. The invention may be implemented with arcuate elements or nodes which simply move from a home position to a training position on command. In addition, elements may move in a rotational or irregular path with departing from the scope of the present teachings. Further, the invention is not limited to the mechanism by which the rods are locked in place. Other locking arrangements may be used. For example, the rods may be constructed of alloys which change shape on command.

It is therefore intended by the appended claims to cover any and all such applications, modifications and embodiments within the scope of the present invention.

Accordingly,

What is claimed is:

1. A reconfigurable clamping and supporting apparatus comprising:

a first array of elements, said first array comprising at least two rows of elements extending along a first axis and at least two columns of elements extending along a second axis substantially transverse to said first axis, each of said elements being adapted to reciprocate from a first position to a second position along a third axis substantially transverse to said first and second axes, said first position being a home position and said second position being a retaining position;

a second array of elements, said second array comprising at least two rows of elements extending along said first axis and at least two columns of elements extending along said second axis, each of said elements being adapted to reciprocate from a first position to a second position along said third axis, each of said elements being adapted to reciprocate from a first position to a second position, said first position being a home position and said second position being a retaining position, said second array being mounted in opposing face-to-face relation relative to said first array to retain an object therebetween when at least one element of each array is disposed at said second position;

means for actuating said elements from said first position to said second position to engage said object and;

locking means, for retaining said elements in said second position said locking means including fulcrum means for applying pressure to said elements along an axis transverse to said third axis.

2. The invention of claim 1 wherein said elements are elongate rods.

3. The invention of claim 2 wherein said rods are adapted to engage in independent translational motion.

4. The invention of claim 3 wherein said elements are arcuate rods.

5. The invention of claim 4 wherein said arcuate rods are adapted to engage in independent arcuate motion.

6. The invention of claim 5 wherein said arcuate rods are adapted to engage in independent rotational motion.

7. The invention of claim 3 wherein said elements are nodes.

8. The invention of claim 7 wherein said nodes are adapted to engage in independent translational motion.

9. The invention of claim 7 wherein said nodes are adapted to engage in independent rotational motion.

10. The invention of claim 1 wherein said means for actuating said elements from said first position to said position to engage said object includes means for applying pneumatic pressure to said elements.

11. The invention of claim 1 wherein said means for actuating said elements from said first position to said position to engage said object includes means for providing hydraulic pressure to said elements.

12. The invention of claim 1 wherein said fulcrum means includes a pneumatic piston adapted for translational motion between a first home position and a second actuated position, a fulcrum attached to said piston on one end and to a pivot point at a point near a second end thereof, and a beam mounted to transfer mechanical pressure from said second end of said fulcrum to said elements when said position is in said second position.

13. A reconfigurable clamping and supporting apparatus comprising:

a first array of elongate rods adapted for independent translational motion, said array comprising at least two rows of elongate rods extending along a first axis and at least two columns of elongate rods extending along a second axis substantially transverse to said first axis, each of said elongate rods being adapted to reciprocate from a first position to a second position along a third axis substantially transverse to said first and second axes, said first position being a home position and said second position being retaining position;

a second array of elongate rods adapted for independent translational motion, said second array comprising at least two rows of elongate rods extending along said first axis and at least two columns of elongate rods extending along said second axis, each of said elongate rods being adapted to reciprocate from a first position to a second position, said first position being a home position and said second position being a retaining position, said first array being mounted in opposing face-to-face relation relative to said second array to retain an object therebetween when at least one elongate rod of each array is disposed at said second position;

means for actuating said elongate rods from said first position to said second position to engage said object, said means for actuating said elements from said first position to said position to engage said object includes means for applying pneumatic pressure to said elements; and locking means for retaining said elements in said second position, said locking means including fulcrum means for applying pressure to said elements along an axis transverse to said third axis.

14. The invention of claim 13 wherein said fulcrum means includes a pneumatic piston adapted for translational motion between a first home position and a second actuated position, a fulcrum attached to said piston on one end and to an adjustable pivot point at a point near a second end thereof, and a beam mounted to transfer mechanical pressure from said second end of said fulcrum to said elements when said piston is in said second position.

* * * * *